US006065569A

United States Patent [19]

Fuller

[11] Patent Number: 6,065,569

[45] Date of Patent: May 23, 2000

[54] VIRTUALLY ACTIVE ELEVATOR HITCH

[75] Inventor: James W. Fuller, Amston, Conn.

[73] Assignee: United Technologies Corporation, Hartford, Conn.

[21] Appl. No.: 09/220,921

[22] Filed: Dec. 24, 1998

[51] Int. Cl.[7] ..... B66B 5/00

[52] U.S. Cl. ..... 187/345; 187/346; 187/292; 187/412; 187/411

[58] Field of Search ..... 187/346, 347, 187/345, 411, 412, 292, 391, 393

[56] References Cited

U.S. PATENT DOCUMENTS

| | | | |
|---|---|---|---|
| 838,322 | 12/1906 | Groom | 187/347 |
| 5,027,925 | 7/1991 | Kahkipuro | 187/115 |
| 5,542,501 | 8/1996 | Ikejima et al. | 187/292 |
| 5,641,041 | 6/1997 | Masuda et al. | 187/411 |
| 5,652,414 | 7/1997 | Roberts et al. | 187/292 |
| 5,750,945 | 5/1998 | Fuller et al. | 187/292 |
| 5,862,888 | 1/1999 | Iwakiri et al. | 187/345 |

FOREIGN PATENT DOCUMENTS

| | | | |
|---|---|---|---|
| 405201652 | 8/1993 | Japan | 187/346 |
| 000602426 | 4/1978 | U.S.S.R. | 187/347 |

*Primary Examiner*—Douglas Hess
*Assistant Examiner*—Steven B. McAllister
*Attorney, Agent, or Firm*—Stephen A. Schneeberger

[57] ABSTRACT

A virtually active hitch system is provided for the damping of vertical oscillations of an elevator car during a semi-active hitch mode of operation along a relatively lengthy elevator travel path and for load leveling the elevator car during an active mode when the elevator is braked. The virtually active hitch stores energy derived from the elevator motor during the semi-active mode, and utilizes that stored energy during the active mode to actively adjust the positioning of the elevator car, as might result from load changes. The hitch assembly may advantageously use hydraulic piston and cylinder means to adjust, or impede adjustment of, a limited hitch gap between a support rope and the elevator car. The hydraulic circuit associated with the piston and cylinder may include a variable orifice valve to control damping action and a pair of accumulators controlled via a switching network to selectively store and release energy and to also serve as a spring.

9 Claims, 5 Drawing Sheets

VIRTUALLY ACTIVE ELEVATOR HITCH

TECHNICAL FIELD

This invention relates to elevator motion control and more particularly to a virtually active elevator hitch for improved elevator motion control.

BACKGROUND

Elevators are controlled to follow a flight (travel) profile which minimizes travel time within certain jerk, acceleration, and velocity constraints. The constraints are selected to ensure a comfortable ride. In practice, elevator vertical motion includes oscillations about the nominal trajectory (profile) that reduce ride comfort. These oscillations are primarily due to various spring/mass oscillation modes of the compliant rope between the elevator motor and the car. These oscillation modes are very lightly damped and thus can be set in motion by small disturbances that occur in flight. These small disturbances include passenger motion, rail joints, mechanical wear, torque ripple produced by the drive and motor, air pressure changes due to passing floor sills, other cars, and structural members in the hoistway, etc.

Elevator motion control is the mechanism by which the elevator is made to follow the nominal travel trajectory. Elevator motion control is typically accomplished using an elevator motion controller. In the elevator motion controller, the nominal profile to be followed by the elevator is input in terms of a dictated velocity of the elevator car along the profile. The dictated velocity is used to form the nominal commanded speed for the elevator motor. Near the end of flight, the position of the elevator car is measured and used to determine a distance to go estimate which is used to determine a correction to this nominal velocity command to ensure that the elevator lands (arrives and stops) at its desired destination in a smooth and controlled manner within a desired landing accuracy.

The motion controller typically includes a machine room motor velocity controller, which provides feedback of motor or sheave velocity in order to implement the motion command. The feedback of motor velocity to motor torque provides co-located damping of the oscillatory modes so that they are more quickly attenuated. In general, there will be some error in following the nominal profile because the oscillations are not attenuated as much as desired. The error is most critical at the end of the flight, where the error is termed "leveling error". The tracking and leveling errors decrease with the bandwidth of the motion control feedback loop and increase with acceleration and deceleration levels. Currently, the bandwidth is limited by the propagation delay through the rope.

In tall buildings, trajectory-following errors are worse because the long hoist rope is more compliant and there is a considerable time delay for the transmission of a motor motion perturbation in the machine room to propagate down the rope to the car. The speed of this tension wave in a typical elevator rope is 2500 to 3500 meters/sec. Thus there is approximately a 0.1 sec delay for a perturbation in the machine room to propagate to the car if the car is 300 meters below the machine room. The presence of this time delay in the motion control feedback loop limits its bandwidth, which limits how quickly the controller reacts to errors in following the nominal flight trajectory and to disturbances. This limitation has two impacts: (1) the elevator vertical oscillations cannot be as well attenuated; and (2) the accuracy to which the car can be made to follow a decelerating trajectory decreases. The taller the elevator rise, the greater the impact of time delay. To maintain accuracy at landing (e.g., to minimize leveling errors), the deceleration rate of the car has to be reduced for tall buildings. This increases floor-to-floor flight time and is therefore undesirable. Therefore, a need exists for an improved elevator motion controller which improves the attenuation of oscillations, without increasing travel times, particularly in buildings with long elevator shafts.

To accurately land, the elevator motion control needs to include some degree of position error feedback. A common way to accomplish this is to make the dictated velocity a function of distance-to-go. Although position feedback is needed to land accurately, it reduces the damping of the oscillatory modes. It is known that a high position gain (i.e., the slope or gain of a dictated speed vs. distance-to-go function) can cause instabilities. It is also known that lowering position gain increases flight time. The degree of position error feedback that can be allowed increases with the damping of the oscillatory modes. It is further known in the art that car acceleration feedback to the velocity command (provided to a drive and brake subsystem) increases this damping in modest size buildings. In tall buildings, this is not effective because of the relatively large time delay in propagating motion from the main motor to the car. Therefore, there further exists a need for improved attenuation of oscillations for improved position error feedback control.

In U.S. Pat. No. 5,750,945 there is described an elevator motion control system which compares a dictated travel path signal, indicative of a desired elevator travel profile, with a measured travel path signal, indicating actual elevator motion, and provides a motion command signal to appropriate circuitry. The frequency of the motion command signal is split into high and low frequency components, and an active force actuator, located at the elevator car, is used to implement the high frequency/low stroke portion of the motion command signal, while the elevator motor is used to implement the low frequency/high stroke portion of the motion command signal.

The active force actuator is located together with a passive damping device between a hitch and an elevator car frame or between the frame and the car. The active force actuator, or actuators, may be electromagnetic voice coils, the extension and contraction of which are provided by control signals applied thereto, or they may be hydraulic actuators, rotary motors with lead screws, or other suitable devices. In each instance the actuator is actively controlled in both directions, i.e., extension and retraction, to improve the vertical motion control of the elevator along its travel path. Such active control enables the actual motion of the elevator to closely track the elevator vertical travel command signal, by compensating for delays occasioned by the length of the elevator rope. However, the energy source for the respective active actuator typically includes a motor, a pneumatic or hydraulic pump, or a large electrical coil located on the elevator car to drive the respective actuator in both directions. Moreover, there is usually a requirement for a heavy electrical power cable, as long as the elevator shaft, to provide the requisite power associated with the actuator. Such arrangements typically are relatively heavy, noisy, and/or costly and may have limited reliability, thus creating a limitation to their overall usefulness in this particular environment. Therefore, there exists a need for further improvement in the type and control of the actuator associated with the elevator car and hitch for damping elevator car vertical oscillations. In tall elevator rises, control of adjustments to the position of an elevator car at rest are required because of changes in load. The above, active force actuator can provide this control without release of the brake on the motor. However, prior active actuators also suffer from the mentioned limitations.

SUMMARY

The present invention provides a system for the damping of oscillations during vertical motion of an elevator car position along an elevator travel path in a manner which is relatively less costly, heavy and/or noisy than the active hitch system previously described. The present invention also provides the function of an active system, including load-leveling adjustments of the elevator car, without the same reliance upon the conventional external power sources of prior active elevator hitches.

The present invention relies upon a controlled use of the hitch system of the invention to take advantage of the elevator motor as an indirect source of energy during semi-active modes of operation in which there is acceleration or deceleration, and to redirect and store that energy for later use in an active mode of operation.

Accordingly, the present invention relates to a virtually active hitch system for the damping of oscillations during a semi-active hitch mode of vertical motion of an elevator car along an elevator travel path and for load leveling the elevator car during an active hitch mode when the elevator motor is braked. The elevator car is connected by a rope to a sheave mounted to the elevator motor. The rope is connected to the car in a manner permitting limited relative vertical motion there between, as controlled by the virtually active hitch system. Importantly, kinetic energy in the motor/rope/car system while the elevator car is moving is transferred to an energy storage system and used for load leveling in the active hitch mode. The virtually active hitch system provides: a motion command signal corresponding with an elevator travel profile dictated by a desired destination of the elevator along its travel path; spring means effectively connected between the rope and the elevator car and operative in the semi-active hitch mode to provide a vertical spring force there between; controllable damping means and adjustment means effectively connected between the elevator car and the rope and being responsive to a damping command signal in the semi-active hitch mode for selectively impeding relative vertical displacement between the elevator car and the rope and being responsive to an adjustment command signal in the active hitch mode for selectively adjusting the relative vertical displacement between the elevator car and the rope; means for providing signals indicative of the measured vertical motion of the elevator car; and control means responsive to the motion command signal and to the measured car motion signal for determining operation in a semi-active hitch mode and providing a damping command signal to selectively control the damping means and for determining operation in an active hitch mode and providing an adjustment command signal to selectively control the adjustment means.

The spring means has a spring constant that is sufficiently low that it is relatively soft so as to ensure that relative vertical travel of the elevator car and the relative vertical travel between the elevator car and the rope remain in phase with one another at the relatively low frequency of elevator car and rope oscillations. The spring means may comprise one or more hydraulic accumulators.

The controllable damping means comprises one or more hydraulic piston and cylinder combinations operatively connected between the elevator car and the rope, as via a hitch assembly having a support member interconnected to the elevator car and a hitch plate engaged by the rope and moveable relative to the support member. The controllable damping means further includes a variable orifice valve to control the flow of hydraulic fluid through a hydraulic circuit to and from the cylinders on both sides of the piston.

A pair of first and second accumulators may serve not only to provide the spring means, but also to store energy indirectly provided by the elevator motor during the semi-active hitch mode of operation and to utilize, or release, the stored energy to power the adjustment means during the active hitch mode of operation. The adjustment means may typically also include the piston and cylinder combination of the damping means.

A switching arrangement is provided in the hydraulic circuit to control hydraulic flow between the opposite ends of the piston and cylinder combination and each, or both, of the accumulators to effect the storage and delivery of energy.

The control means of the system may additionally respond to a measured car motion signal indicative of the acceleration of the elevator car to control the switching arrangement in the hydraulic circuit to store energy during intervals of acceleration and responds to a signal indicative of the motor being braked to control the switching arrangement to release some of the stored energy to operate the position adjustment means during car unloading and reloading.

The above identified system is a virtually active hitch in that it effects active adjustment of the elevator car level as a result of load changes, yet does not require the external supply of power required by prior active adjustment systems. Moreover, it utilizes energy delivered by the motor in the semi-active mode of operation as the source for the energy stored for leveling adjustments.

The foregoing features and advantage of the present invention will become more apparent in light of the following detailed description of exemplary embodiments thereof as illustrated in the accompanying drawings.

BRIEF DESCRIPTION OF DRAWINGS

FIG. 3A depicts the virtually active hitch, with high and low pressure accumulators, in a neutral state;

FIG. 3B depicts the virtually active hitch during positive (upward) acceleration of the elevator showing pumping up of the high pressure accumulator;

FIG. 3C depicts the virtually active hitch during a constant velocity phase of the elevator;

FIG. 3D depicts the virtually active hitch during negative (downward) acceleration of the elevator showing pumping down of the low pressure accumulator; and FIG. 3E depicts the virtually active hitch in an active mode for improving ride quality of the elevator, particularly when landing, and during load changes to re-level the elevator car.

BEST MODE FOR CARRYING OUT THE INVENTION

The present invention provides a significant improvement in the motion control of an elevator through the use of a virtually active hitch for interconnecting either an elevator car to a main rope or the elevator car to the main frame. The virtually active elevator hitch includes semi-active damping devices acting in parallel and/or in series with passive spring devices. Moreover, the virtually active elevator hitch includes hydraulic accumulators to provide passive spring forces and, in combination with hydraulic damping devices and appropriate switching of hydraulic circuitry, to provide a means for storing and releasing energy for active control of the elevator car. The system provides improved ride quality and flight time of an elevator, particularly in tall buildings, with reduced reliance upon external power sources.

Figure 1:
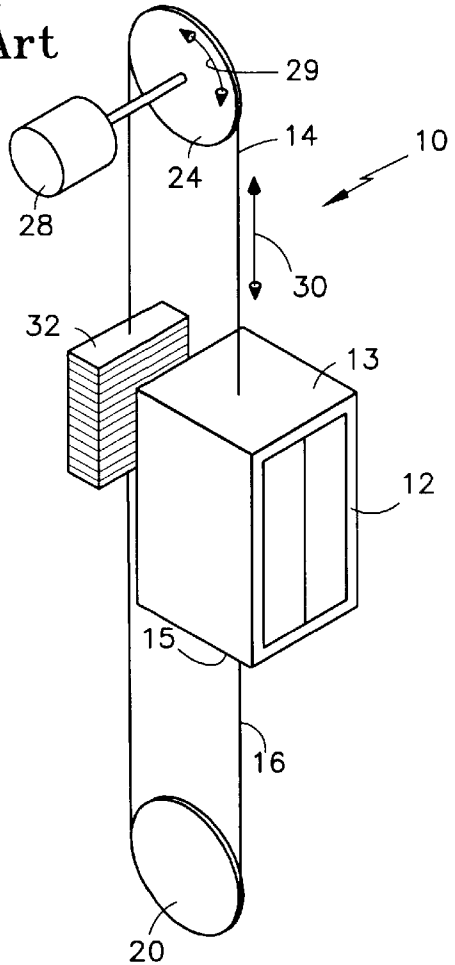
FIG. 1 Prior Art
FIG. 1 is a schematic diagram of an elevator.

Referring to FIG. 1, as is known in the art, an elevator 10 includes an elevator car 12 connected at one end 13 to a main rope 14 and, although not necessarily, at the other end 15 to a compensation rope 16 within an elevator shaft (not shown). The compensation rope 16 is received around a compensation pulley 20 and the main rope 14 is received around a sheave 24, e.g., torsion sheave. The sheave 24 is interconnected to a motor 28, e.g., an electric motor or a hydraulic motor, for rotational movement of the sheave 24. Rotational movement 29 of the sheave 24 is translated into longitudinal movement 30 of the elevator car 12 via the main rope 14. As is known in the art, a counterweight 32 may be provided for countering the weight of the elevator car 12. It will be understood by those skilled in the art that the elevator configuration of FIG. 1 is provided to illustrate the general environment of the invention, and various other elevator configurations may be used with the present invention including configurations that do not use a compensation rope and pulley or a counterweight per se, such as a configuration utilizing a linear motor, a two-to-one roping or other scheme, and a double wrapped traction scheme on the drive sheave, just to name a few alternate configurations.

Figure 2:
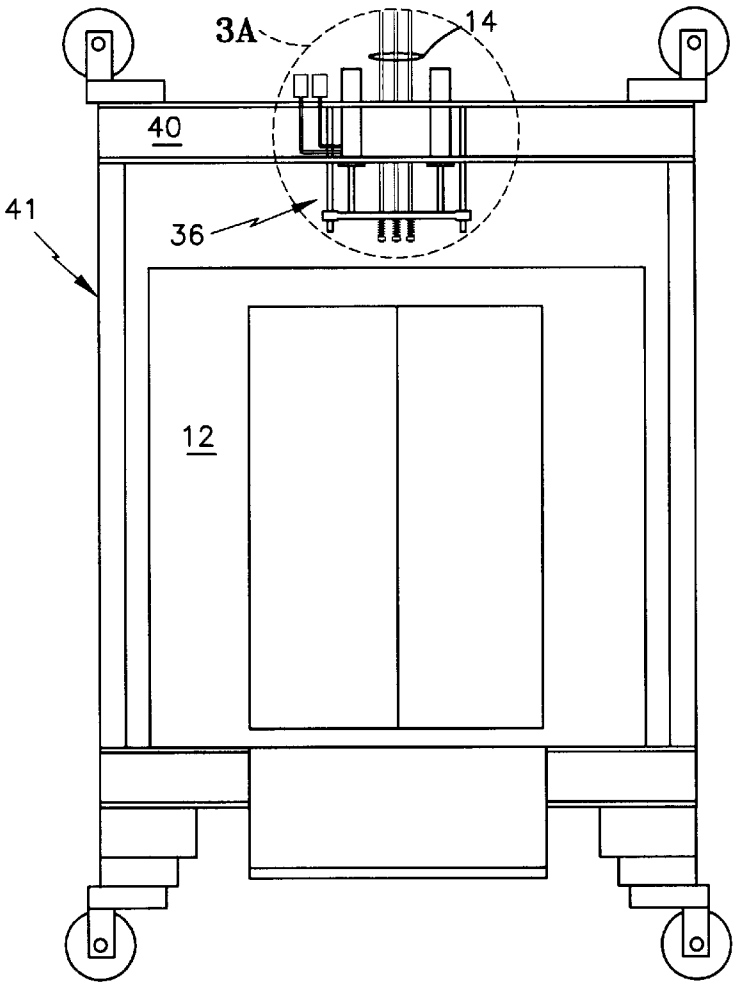
FIG. 2 is a diagram of an elevator car having a virtually active hitch in accordance with the present invention.
Figure 3A:
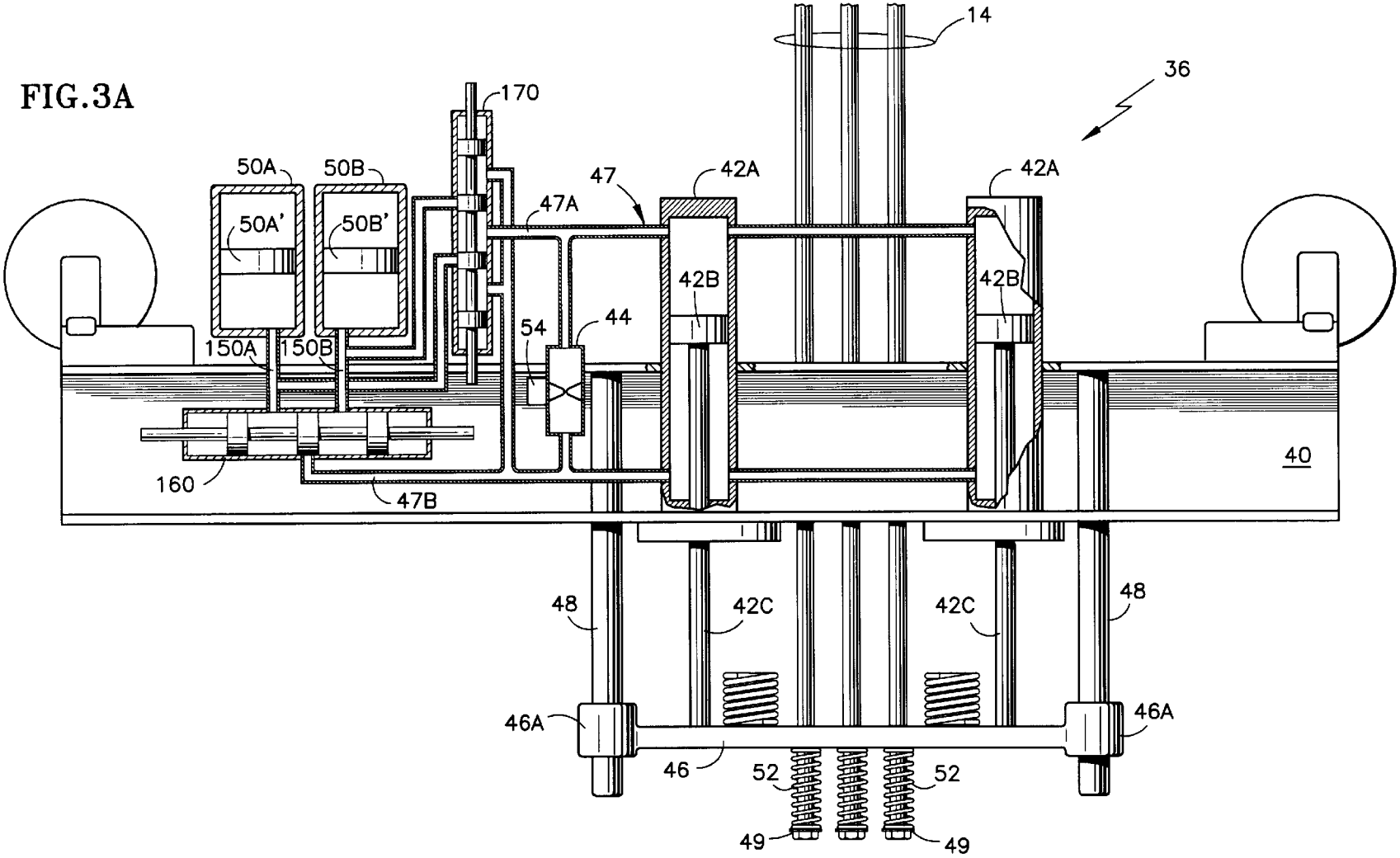
FIGS. 3A through 3E depict the virtually active hitch of FIG. 2 in enlarged form and differing states, specifically.

Referring now to FIG. 2, the elevator car 12 is interconnected to the main rope 14 by a virtually active hitch assembly 36 which is shown in greater detail in FIGS. 3A–3D. Referring also to FIGS. 3A–3D, the virtually active hitch assembly 36 provides for the interconnection of the elevator car 12 to the main rope 14. As illustrated in FIG. 3A, the main rope may include a plurality of steel cables, e.g., three (3) steel cables, which are interconnected to the elevator car 12 via the virtually active hitch assembly 36. In the illustrated example, the main rope 14 passes through a support plate 40 and a hitch 46 and is attached to rope terminators 49. The support plate 40 may be a separate plate, or, as depicted here, it may form part of the elevator frame 41. Positioned between the terminators 49 and the hitch plate 46 are a plurality of passive hitch spring elements 52. In the illustrated example, the passive hitch spring elements 52 positioned between the hitch plate 46 and terminators 49 each have one of the steel ropes which make up the main rope 14 passing there through. The passive hitch spring elements 52 provide even tension among the steel ropes which make up the main rope.

Positioned between the hitch plate 46 and the support plate 40 is part of the virtually active hitch assembly 36, which includes a pair of cylinders 42A and pistons 42B and a variable orifice valve 44 connected in a hydraulic circuit 47. The hydraulic circuit 47 connects the opposite ends of the cylinders 42A. The hydraulic circuit 47 additionally is connected to a pair of gas-pressurized accumulators 50A and 50B, such that the accumulators 50A and 50B and the cylinders 42A and pistons 42B serve as a passive gas hitch spring connected in parallel with the virtually active hitch assembly.

At this juncture it should be noted that the virtually active hitch assembly 36 of the present invention includes a portion for semi-active damping of oscillations of the elevator car and a portion, partly in common, for active control of parts of the elevator car's flight and load leveling when the elevator motor is braked. Although much of the structure is common to the two functions, it should be understood that the arrangement for the semi-active damping of oscillations is described in detail in a commonly owned application 09/219,962, now pending entitled "Semi-Active Elevator Hitch" by Fuller et al. filed on even date herewith, which application is incorporated herein by reference for its disclosure which is relevant hereto and consistent herewith. The cylinders 42A are fixedly mounted to the support plate 40 and may typically extend there through because of their length, which may be greater than 20 inches. Similarly, the pistons 42B and their associated piston rods 42C are in continuous engagement with and are preferably affixed to, the hitch plate 46. The hitch plate 46 is positioned below the support plate 40 and thus is urged relatively toward (upward) plate 40 by the weight of the elevator car 12 and frame 41 relative to the rope 14 and also by springs 52. The hitch plate 46 includes linear bearings 46A at opposite ends which slide on a respective pair of guide rails 48 which depend, in cantilever fashion, from the support plate 40.

The accumulators 50A and 50B are selectively connected to the hydraulic circuit 47 at locations between the variable orifice valve 44 and the opposite ends of the cylinders 42A. The accumulators 50A and 50B are prepressurized with nitrogen gas or the like, to a pressure sufficient to apply a pressure to the hydraulic circuit 47 such that the pistons 42B are normally biased to a mid-range position in the cylinders, as in FIG. 3A, and thereby serve as a soft spring for providing an initial "lifting" force to the elevator car 12 relative to the cable 14.

The variable orifice valve 44 may be any of a variety of types which respond directly or indirectly to a signal to control the size of the orifice and thus the hydraulic impedance of the circuit 47. In the illustrated embodiment, the variable orifice valve 44 may include a linear or rotary element which responds to a linear or rotary stepper motor (not shown) to relatively close or open the orifice. Other mechanisms may also be used, such as an electrically deformable element to control the orifice.

By selectively controlling the size of the orifice in the orifice valve 44, it is possible to regulate the impedance of the hydraulic circuit 47 and thereby regulate or controllably damp the stroke of pistons 42B in their cylinders 42A against the vertical forces acting relatively between the elevator car 12 and the rope 14. In this way, transitory forces acting relatively either upwardly or downwardly on the elevator cab 12 relative to the rope 14 may be resisted by the semi-active oscillation damping portion of the vertical active hitch assembly 36.

As mentioned, the gas spring provided by the accumulator 50A and 50B are designed to be relatively "soft", and may have a spring constant less than half that of rope 14. This is done to ensure that the hitch stroke remains in phase with the oscillatory motion of the elevator car 12. In this way the semi-active hitch assembly 36 may be controlled to resist or damp relatively low frequency (i.e., less than about 5 Hz) oscillatory motion of the elevator car 12 and rope 14. Thus, the cylinders 42A/pistons 42B and valve 44, when operating in the semi-active damping mode, are required only to dissipate energy. This avoids the need for a separate significant energy source at the elevator car 12 or frame 41 for that mode of operation, except for a relatively small and simple driver to control the orifice of orifice valve 44.

Referring further to FIG. 3A, a pressure sensor 54 is operatively connected to the hydraulic circuit 47 at opposite ends of the variable orifice valve 44 to develop and provide an electrical signal, ΔP, representative of the pressure difference across the valve's orifice. This signal is reflective of the force gradient or tension, across the orifice valve 44 and is used in the control algorithms as will be hereinafter explained.

To further appreciate the operation of the damping system formed by the variable orifice valve 44, the pistons 42B and the cylinders 42A and the gas spring formed by the accumulators 50A and 50B, it is useful to understand the force relationships in the system. The "downward" force on a piston 42B is the product of the "upper" hydraulic pressure, $P_U$, and the area, $A_C$, of the cylinder. Similarly, the "upward" force on that piston is the product of the "lower" hydraulic pressure $P_L$ and the net area, which is the area, $A_C$, of the cylinder minus the area, $A_R$, of the piston rod 42C. Thus, $P_U A_C - P_L (A_C - A_R)$ represents the opposing forces on the opposite faces of piston 42B. That expression may be resolved into a damping component, $(P_U - P_L)A_C$, and a spring component, $P_L A_R$.

Attention is now given to those elements and functions of the virtually active hitch assembly 36 which additionally enable it to perform in an active manner with a minimal requirement for external power. Referring further to FIG. 3A, the hydraulic circuit 47 is seen to have an upper arm 47A connected to the upper end of cylinders 42A and a lower arm 47B connected to the lower end of cylinders 42A. Through selective switching of various hydraulic connections between the accumulators 50A and 50B and the upper and lower hydraulic circuit arms, 47A and 47B, it is possible to store energy indirectly provided by the motor 28 during operation in the semi-active mode. During flight of the elevator car 12, the pistons/cylinders 42B/42A are allowed to stroke in one direction to pump hydraulic fluid into the "high" pressure accumulator 50A and allowed to stroke in the other direction to drain fluid from the "low" pressure accumulator 50B. The deviation of car 12 from the nominal trajectory is corrected by motor 28. The additional energy thus provided by motor 28 indirectly represents the energy transferred to the hydraulic system and the accumulators 50A and 50B. That energy may be stored by selectively directing hydraulic fluid under increased pressure into the "high" pressure accumulator 50A and/or by pumping down the hydraulic fluid and the pressure in the "low" pressure accumulator 50B. This provides a requisite pressure differential for use in the active control of the cylinders and pistons, 42A, 42B, wherein the energy stored at accumulators 50A and 50B is connected by selective switching to one side or the other of the cylinders 42A to effect a requisite displacement of pistons 42B.

Each accumulator 50A and 50B including a respective hydraulic conduit, 150A and 150B through which hydraulic fluid enters and exits. Each of the conduits 150A and 150B is branched to provide a pair of remote ports, one port being connected to a 3-way spool valve 160 and the other port being connected to a 4-way spool valve 170. Similarly, the upper hydraulic circuit arm 47A has a port connected to the 4-way valve 170 and the lower hydraulic circuit arm 47B is branched to provide a remote port connected to the 3-way valve 160 and a pair of remote ports connected to the 4-way valve 170. The 3-way valve 160 and the 4-way valve 170 are of conventional design and are each activated by respective control signals applied to low power actuators (not shown), such as stepper motors or the like.

FIG. 3A depicts the virtually active hitch system 36 in a neutral state. Both accumulators 50A and 50B are at substantially equal pressures, as reflected by the equal positions of the pistons 50A' and 50B'.

Discussion of the dynamics of the virtually active hitch system 36 follows, with reference to FIGS. 3B–3E wherein only those portions of FIG. 3A germane to the discussion are shown. Some license has been taken in not fully depicting the changes in valve spool positions for the 4-way valve 170, the orifice size of variable orifice valve 44 and the positions of pistons 42B. Instead, those positions should be inferred from the accompanying description, and will be obvious to those of ordinary skill in the art. Conversely, changes in the displacement of the pistons 50A' and 50B' in accumulators 50A and 50B, and the positions of the valve spool in the 3-way valve 160 have been depicted.

The sequence in the description that follows is for an upward trajectory of the elevator car 12. Those skilled in the art will understand that the sequence of upward acceleration, constant velocity, and downward acceleration will be reversed for a downward trajectory.

Figure 3B:
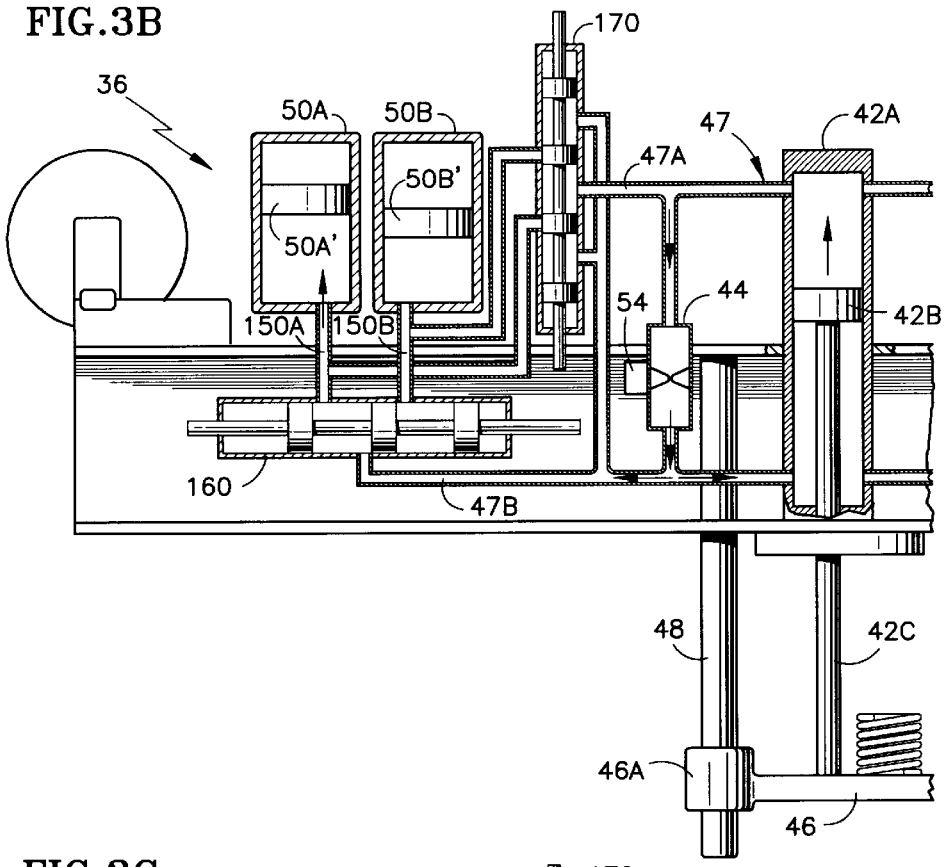

FIG. 3B depicts the virtually active hitch assembly 36 during positive, or upward, acceleration of the elevator car 12. During such interval, the piston 42B in cylinder 42A is accelerating upwardly as the motor 28 turns up, as shown by the upwardly directed arrow at piston 42B. The 4-way valve 170 is closed and the variable orifice valve 44 is relatively open to control the piston rate, but to also allow flow of fluid in hydraulic circuit 47 and 47B as shown. The 3-way valve 160 is open to provide connection only with high pressure accumulator 50A, such that the hitch gap is allowed to close somewhat and the pressure in accumulator 50A increases, for example to a value of 1.1 of the static weight of the elevator relative to the area of piston rod 42C. In this way, energy transfers from the motor 28 to the high accumulator 50A.

Figure 3C:
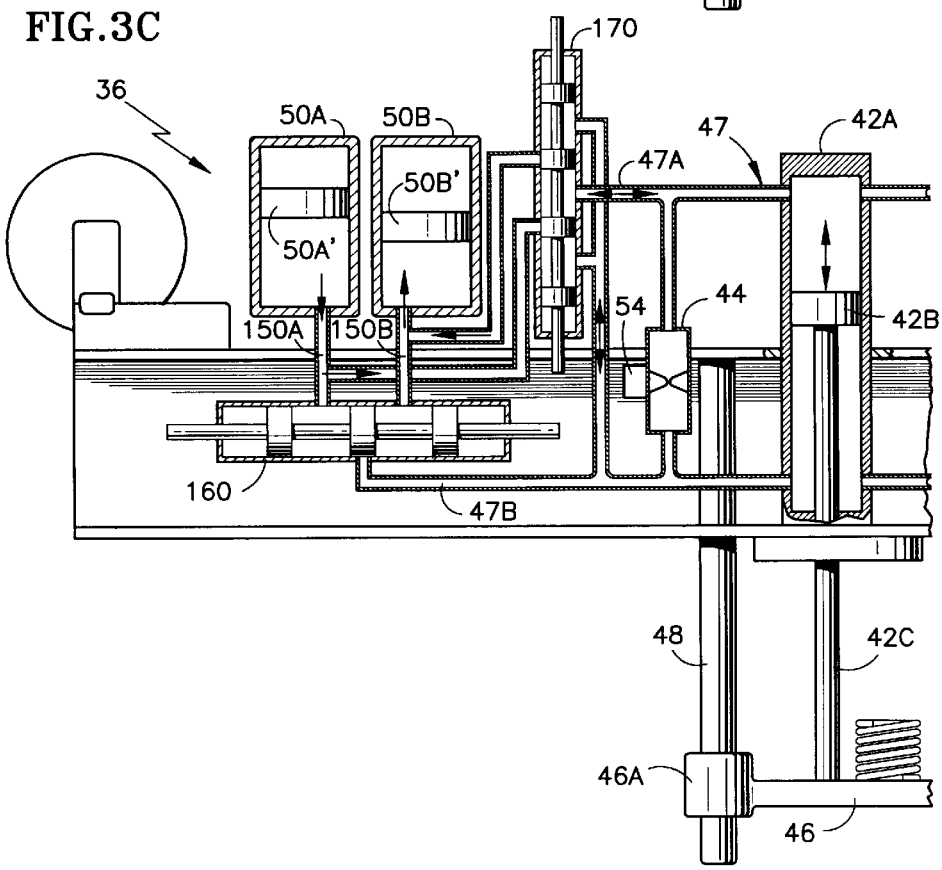

FIG. 3C depicts the virtually active hitch system 36 during a constant velocity phase of elevator operation. The 3-way valve 160 is closed and the 4-way valve 170 is opened to a position allowing bi-directional flow in the hydraulic circuit 47 via the 4-way valve. The variable orifice valve 44 is closed. This allows for small adjustments in hitch displacement in this active mode to improve the smoothness of the ride, as represented by the bi-directional arrows associated with piston 42B. The 4-way valve 170 is positioned to deliver flow from the high-pressure accumulator 50A to the low-pressure accumulator 50B for whichever direction of displacement of piston 42B is required. Alternatively, the hitch system can remain in semi-active mode during the constant velocity phase. Then the 4-way valve 170 remains closed, and the 3-way valve 160 is adjusted to connect whichever accumulator will be used at the end of flight into the hydraulic circuit.

Figure 3D:
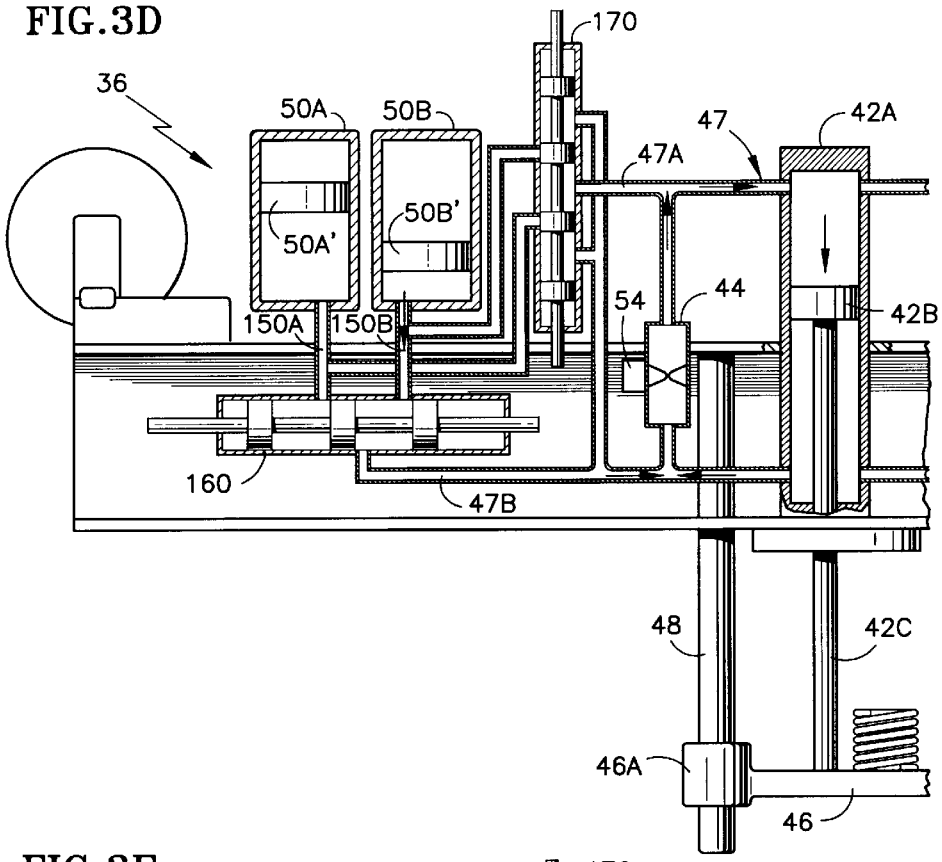

FIG. 3D depicts the virtually active hitch assembly 36 during negative, or downward, acceleration of the elevator car 12. During such interval, the piston 42B in cylinder 42A is accelerating downwardly. The 4-way valve 170 is closed and the variable orifice valve 44 is relatively open to control the piston rate, but to also allow flow of fluid in the hydraulic circuit 47 and 47B as shown. The 3-way valve 160 is open to provide connection only with low pressure accumulator 50B, such that the hitch gap is allowed to expand and the pressure in accumulator 50B decreases, for example to a value of 0.9 of the static weight of the elevator relative to the area of the piston rod 42C. In this way, energy transfers from the low-pressure accumulator 50B to the motor 28. This phase helps to increase the differential in pressure between the high accumulator 50A and the low accumulator 50B for effecting an action.

Figure 3E:
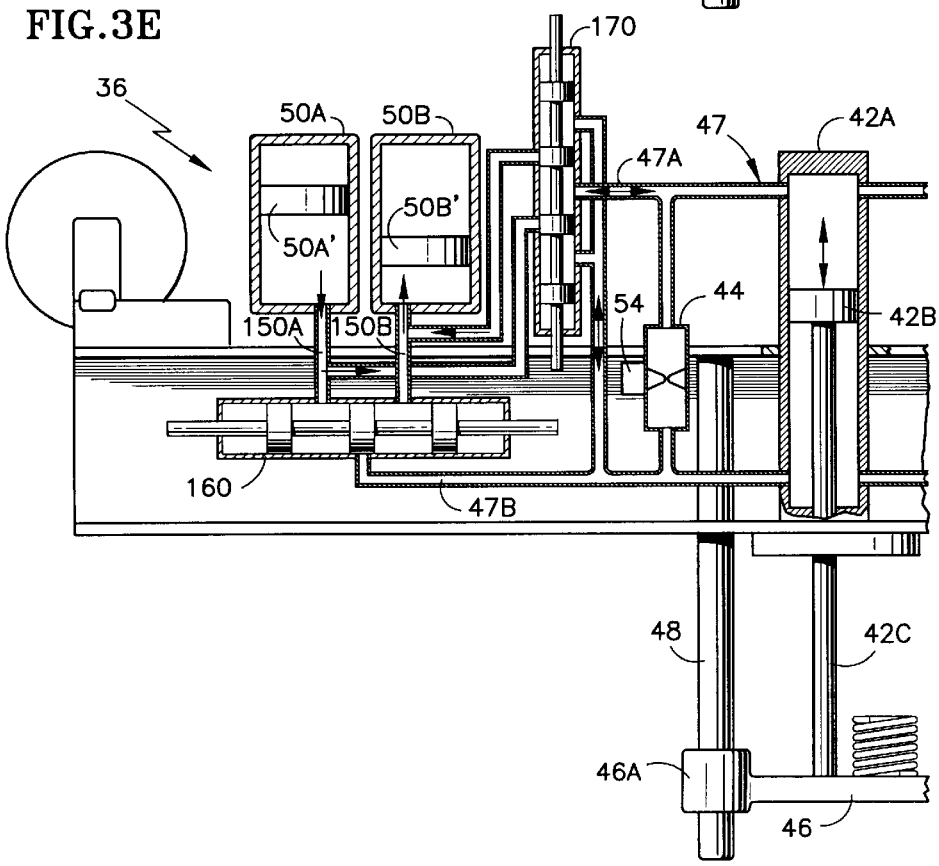

FIG. 3E depicts the virtually active hitch assembly 36 in an active mode either upon approach to landing or while re-leveling to adjust for load changes. In most respects it is similar to FIG. 3C, however, it presumes a greater pressure differential between the accumulators 50A and 50B as illustrated by the significantly different positions of their pistons 50A' and 50B' respectively. The 3-way valve 160 is closed and the 4-way valve is opened to a position controlling bi-directional flow in hydraulic circuit 47 as is necessary for moving the piston 42B relatively upward or downward. In each instance, the fluid flow is from the high-pressure accumulator 50A through the circuit 47 to the low-pressure accumulator 50B. In each instance, the variable orifice valve 44 is closed. In the instance of approach to landing, it is viewed as a transition to constant speed, that speed being zero. In the instance of re-leveling, the brakes to motor 28 have been applied and as the level of the elevator car 12 changes with people (or other loads) entering or exiting, the level of the car is adjusted by the active hitch control mode.

Figure 4:
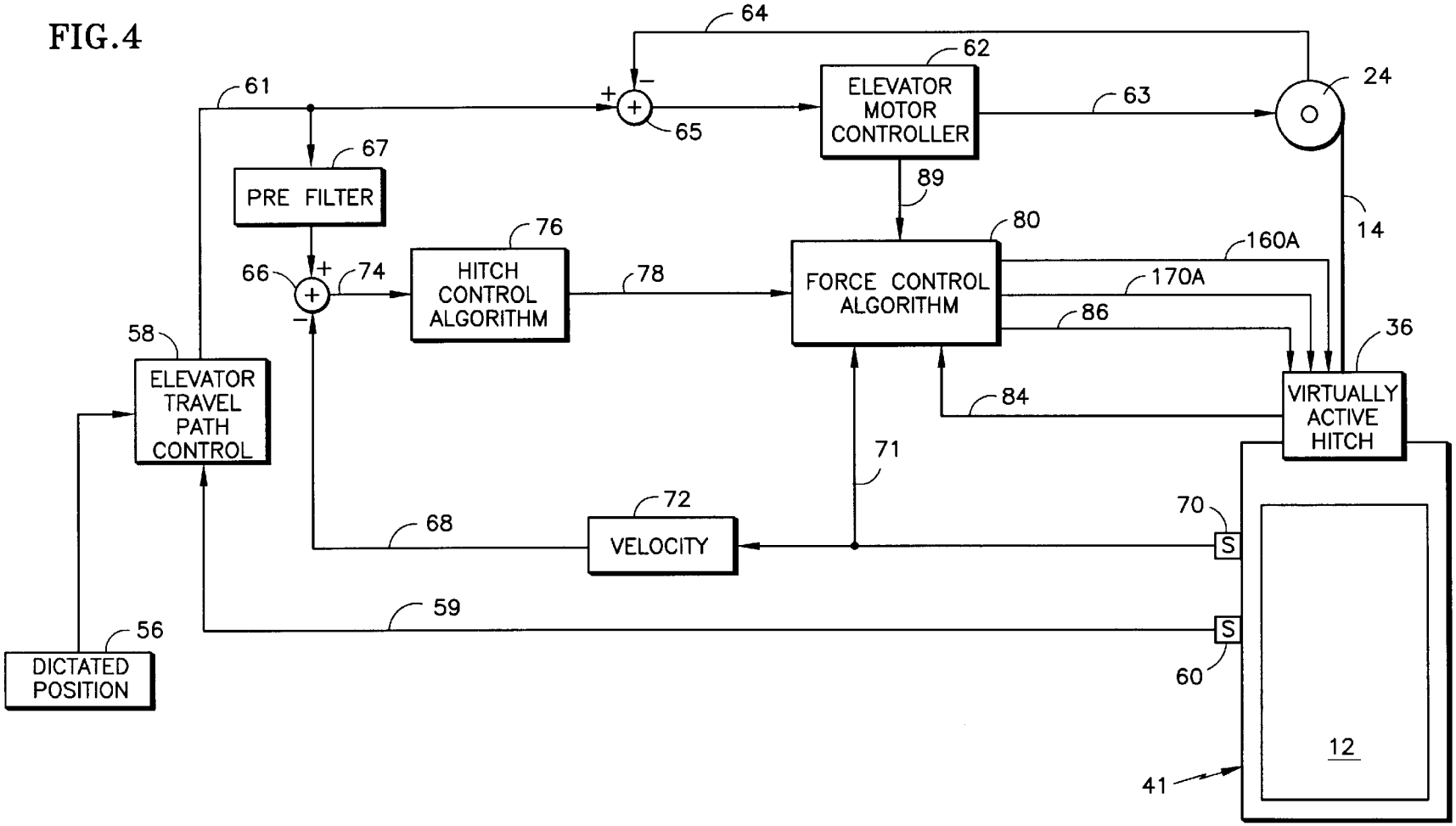
FIG. 4 is a schematic block diagram of a control system for controlling an elevator motor and virtually active elevator hitch in accordance with the invention.

Reference is now made to FIG. 4 which depicts the control system which may be used for controlling the elevator motor and also, importantly, the virtually active elevator hitch of the invention. A signal representative of a desired or dictated position of the elevator car 12 is provided by the signal source 56, and serves as an input to an elevator travel path controller 58. The elevator travel path controller 58 generates control signals in accordance with a dictated travel profile for controlling the elevator motor 28 (therefore sheave 24) and the variable orifice valve 44, the 3-way valve 160, and the 4-way valve 170 (FIG. 3A) of the semi-active and active modes associated with the virtually active hitch assembly 36. A further input to the elevator travel path controller 58 is a feedback signal on the line 59 from the position sensor 60 which indicates the position, and thus the controlled response, of the elevator car 12. Position sensor 60 is mounted on frame 41, though it might also be mounted on the car 12 or other elements that move with the car and frame.

The elevator travel path controller 58 provides a motion command signal on line 61 which is extended to an elevator motor controller 62, via a summer 65. The motion command signal on line 61 typically commands a velocity, though it might alternatively involve other parameters. The elevator motor controller 62 provides control signals on the line 63 to the elevator motor 28 for controlling the speed of the elevator motion (FIG. 1), and therefore sheave 24, to implement the motion command signal. The control response of the elevator motor 28 (FIG. 1) and/or sheave 24 to the signals provided on line 63 is provided as feedback on the line 64 to another input to summer 65 in the way known in the art for controlling the speed of the elevator motor 28 (FIG. 1).

The motion command signal on line 61 is additionally extended to the control circuitry for the virtually active hitch assembly 36. Specifically, the motion command signal on line 61 is extended through a lag prefilter 67 to summer 66 where it is arithmetically summed or compared with a velocity feedback signal on line 68. The lag prefilter 67 introduces a delay to simulate the delay in rope 14. The velocity feedback signal on line 68 is representative of the velocity (rate and direction) of motion of the elevator car 12/frame 41, and is provided by a sensor 70 mounted thereon. The sensor 70 typically is an accelerometer or the like, the output of which may be integrated, as at integrator 72, to provide the rate or velocity signal on line 68.

The motion command signal on line 61 is indicative of a commanded direction of travel and, to some extent, the velocity commanded. That signal, after modification by comparison at summer 66 with the actual velocity/direction signal being fed back on line 68, results in an error signal on line 74 which is extended to a hitch control algorithm circuit 76, where it is appropriately scaled by a gain. The resulting signal from the hitch control algorithm circuit 76 represents the damping component of the force to be applied by the virtually active hitch assembly 36 operating in its semi-active mode. That signal is scaled down by cylinder area to be in terms of pressure across the variable orifice valve 44 and is extended on line 78 to force control algorithm circuitry 80. Further, the pressure difference ΔP across variable orifice valve 44 (FIG. 3A), as measured by the pressure differential sensor 54 (FIG. 3A), is fed back via line 84 to the force control algorithm circuitry 80.

The force control algorithm circuitry 80 treats the input command signal on line 83 as a measure of the desired or commanded pressure differential value ΔPc, and translates that to a commanded opening area of the orifice in the variable orifice valve 44 in accordance with:

$$\text{Area command} = \text{Area} * \text{sq. root } (\Delta P/\Delta Pc) + Kv * (|\Delta|P - |\Delta Pc|) \text{ when } \Delta P/\Delta Pc > 0 \text{ and}$$

$$\text{maximum area when } \Delta P/\Delta Pc \leq 0,$$

each where ΔP is the actual measured pressure difference across the variable orifice valve 44 and ΔPc is the commanded pressure difference as a function of the motion command signal on line 61 as modified by summer 66 and the hitch control algorithm circuit 76. The resulting area command signal is further translated, by a lookup table associated with the force control algorithm circuitry 80, into a valve drive motor command signal appearing on line 86. The valve drive motor command signal on line 86 is extended to a small stepper motor or the like (not shown) which adjusts the orifice area of the variable orifice valve 44.

When the elevator car 12 is approaching a landing or when it is stopped to load or unload passengers, the variable orifice valve 44 will be closed. In the aforementioned co-pending application addressing a semi-active hitch, the valve 44 was closed to ensure a constant hitch gap and presumably, positional accuracy. However, in the present application, although valve 44 is closed under the same conditions, it is possible for fluid to flow in the hydraulic circuit 47 to provide a leveling adjustment in the active mode of the virtually active hitch 36 in accordance with the invention.

Indeed, the force control algorithm 80 additionally receives an input of the measured acceleration of the elevator car 12 via line 71 from the acceleration sensor 70, and an input of the brake signal on line 89 from the elevator motor controller 62. These signals, in conjunction with the motion command signal on line 61, serve to establish the semi-active and active modes of operation for the virtually active hitch assembly 36. The motion command signal on line 61 and subsequently on line 78, is referenced to measured position and/or velocity of the elevator car 12. Thus, inputs of brake status, acceleration status, velocity status, position status and the ΔP across the variable orifice valve 44 cumulatively serve at the force control algorithm function 80 to establish the requisite control modes.

The relationships of the aforementioned parameters to the establishment of the operating modes for the virtually active hitch assembly 36 will be evident from the characteristics discussed in describing the hitch arrangements of FIGS.

3A–3E. When the car is meant to hold steady at a landing, signal 61 will be a motion command, typically velocity, proportional to car position error. In this case, signal 78 will be an additional component to force at the hitch calculated to smoothly move the car relative to the rope to correct car position error. In addition to the force control algorithm function 80 providing a command signal on line 86 for the variable orifice valve 44, there are also provided a command signal on line 170A for the 3-way valve 170 and a command signal on line 160A for the 4-way valve. These signals are provided as a function of the determined mode and are scaled or selected to effect the requisite control of the respective valve. Conditions of acceleration of the elevator car 12 serve to establish the semi-active mode (FIGS. 3B and 3D), during which oscillations are damped and energy derived from motor 28 by allowing stroking of pistons/cylinders 42B/42A is stored in the high pressure accumulator 50A through control of valves 160 and 170. Similarly, conditions of relatively constant velocity, or relatively zero velocity as when stopped at a landing, serve to establish the active mode during which the stored energy is released, through appropriate command to valves 160 and 170, to actively adjust the hitch. It will be appreciated that in some instances, depending on system geometry and the recent history of operation, there may not be sufficient energy stored to fully respond to all active control needs; however, it will be appreciated that to the extent any response is made it serves to lessen the need for the brake to be released and the motor 28 started briefly for the adjustment. The net result is smooth and rapid control of the motion of elevator car 12, particularly in long hoistways.

Engineering analysis for a 267 meter tall hoistway for a 2000 Kg load (max gross mass of 6900 Kg) shows a virtually active hitch can be implemented, as in FIGS. 3A–3E, with 4000 psi pressure rated hydraulics, 4 inch diameter cylinders 42A with 2 inch diameter piston rods 42C, and 6 inch diameter by 10 inch accumulators. The cylinders 42A accommodate a 24 inch stroke of pistons 42B. Further, the analysis reveals that the transition from active mode to semi-active mode at the start of flight, from use of one accumulator 50A or 50B to the other during flight, and from semi-active mode to active mode at the end of flight can occur smoothly without adverse affect on vertical ride quality.

Although the invention has been described and illustrated with respect to the exemplary embodiments thereof, it should be understood by those skilled in the art that the foregoing and various other changes, omissions and additions may be made without departing from the spirit and scope of the invention.

What is claimed is:

1. A virtually active hitch system for damping oscillations of an elevator car during vertical motion of the elevator car along an elevator travel path and for leveling the elevator car to adjust for load changes when the elevator motor is braked, the elevator car being connected by a rope to a sheave mounted to an elevator motor, the rope being connected to the car through a hitch assembly in a manner permitting limited relative vertical motion there between, the system comprising:

means for providing a motion command signal which corresponds with an elevator travel profile dictated by a desired destination of the elevator along the elevator travel path;

spring means effectively connected between the rope and the elevator car and operative in a semi-active hitch mode to provide a vertical spring force there between;

controllable damping means and adjustment means effectively connected between the elevator car and the rope and being responsive to a damping command signal in the semi-active hitch mode for selectively impeding relative vertical displacement between the elevator car and the rope and being responsive to an adjustment command signal in an active hitch mode for selectively adjusting the relative vertical displacement between the elevator car and the rope;

means for providing signals indicative of the measured vertical motion of the elevator car; and control means responsive to the motion command signal and to the measured car motion signal for determining operation in the semi-active hitch mode and providing a damping command signal to selectively control the damping means and for determining operation in the active hitch mode and providing an adjustment command signal to selectively control the adjustment means.

2. The system of claim 1 wherein the controllable damping means and adjustment means are selected to store energy indirectly derived from the elevator motor during the semi-active hitch mode of operation and to utilize the stored energy to power the adjustment means during the active hitch mode of operation.

3. The system of claim 2 wherein the spring means has a spring constant sufficiently low that it is relatively soft, thereby to ensure that relative vertical travel of the elevator car and relative vertical travel between the elevator car and the rope remain in phase with one another at the relatively low frequency of elevator car and rope oscillations.

4. The system of claim 3 wherein the hitch assembly connecting the elevator car and the rope comprises a support member interconnected to the elevator car and a hitch plate engaged by the rope and moveable relative to the support member, and wherein the controllable damping means engages the support member and the hitch plate to controllably damp relative motion there between.

5. The system of claim 4 wherein the controllable damping means comprises at least one hydraulic piston and cylinder combination operatively connecting the support member and the hatch plate, a hydraulic circuit for supplying hydraulic fluid to and from the cylinder on opposite sides of the piston, and a variable orifice valve connected in the hydraulic circuit for regulating the flow of hydraulic fluid there through in response to the damping command signal to thereby impede relative vertical motion between the elevator car and the rope.

6. The system of claim 5 wherein said spring means comprises at least one hydraulic accumulator, said at least one accumulator being hydraulically connected to said hydraulic circuit and having a gas precharge, and being sized and pressurized to establish said spring constant in the hydraulic circuit.

7. The system of claim 6 wherein said spring means comprises at least a pair of first and second hydraulic accumulators, and wherein said controllable damping means and adjustment means includes switching means for selectively interconnecting each of said first and second accumulators into and out of said hydraulic circuit, thereby to selectively receive and store energy from the piston and cylinder combination and to release the stored energy back to the piston and cylinder combination.

8. The system of claim 7 wherein the variable orifice valve is connected hydraulically in parallel with the piston and cylinder combination.

9. The system of claim 7 wherein said measured vertical motion signals include a signal indicative of the vertical acceleration of the elevator car, said control means is further responsive to said acceleration signal to provide a switching means control signal, and said switching means is responsive to said switching means control signal to connect only said first hydraulic accumulator into said hydraulic circuit during acceleration in one direction and only said second hydraulic accumulator into said hydraulic circuit during acceleration in the opposite direction, such that energy is stored in said first and second accumulators by creating a pressure differential there between.

* * * * *